US006912730B1

(12) United States Patent
Inman

(10) Patent No.: US 6,912,730 B1
(45) Date of Patent: Jul. 5, 2005

(54) PRESSURE RELIEVING TIE HOLDER

(76) Inventor: David Inman, 3018 San Pablo Ave., Berkeley, CA (US) 94702

( * ) Notice: Subject to any disclaimer, the term of this patent is extended or adjusted under 35 U.S.C. 154(b) by 0 days.

(21) Appl. No.: 10/824,726

(22) Filed: Apr. 14, 2004

(51) Int. Cl.[7] ..... A41D 25/04
(52) U.S. Cl. ..... 2/145; 24/49.1
(58) Field of Search ..... 2/144–151, 152.1, 2/153–156; 24/49.1, 54, 65, 66.3, 66.2

(56) References Cited

U.S. PATENT DOCUMENTS 1,798,432 A 3/1931 Ratajack
3,128,471 A 4/1964 Bertrand
3,381,865 A 5/1968 Pehr
3,474,503 A 10/1969 Less
4,554,710 A * 11/1985 Grant ..... 24/66.1
4,827,536 A 5/1989 Sung
4,920,579 A 5/1990 Swain
5,095,546 A 3/1992 Jones
5,337,457 A 8/1994 Chennault
5,353,438 A 10/1994 Voiles
6,131,200 A 10/2000 McNamara
6,691,320 B2 * 2/2004 Smith ..... 2/145

* cited by examiner

*Primary Examiner*—Tejash Patel
(74) *Attorney, Agent, or Firm*—Sheppard Mullin Richter & Hampton LLP

(57) ABSTRACT

A necktie holder for maintaining a necktie in position is disclosed. The holder has a generally elongate body which attaches at one end to the collar button on a user's shirt and which attaches at the other end to a knot in the user's necktie. The attachment mechanism for the collar button may be a buttonhole in an enlarged portion of the tie holder, and the attachment mechanism for holding the tie may be a hook. The holder may be constructed from plastic so that it is inexpensive and semi-disposal.

13 Claims, 2 Drawing Sheets

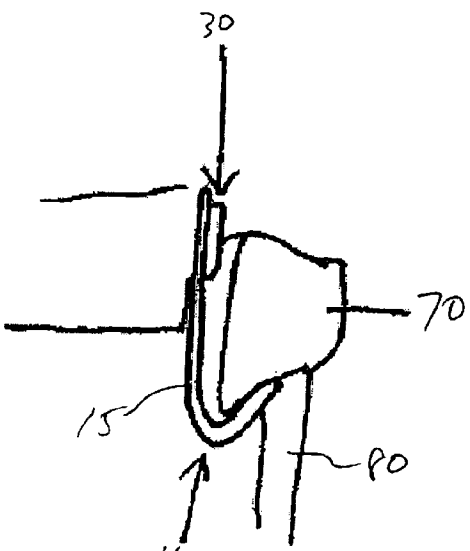
FIG. 3
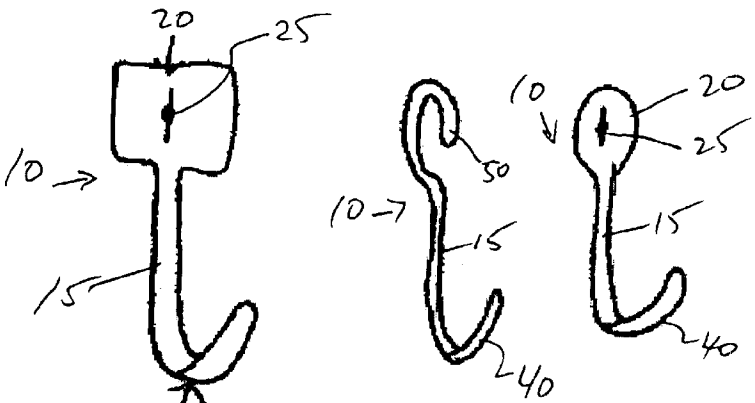
FIG. 4A
FIG. 4B
FIG. 4C
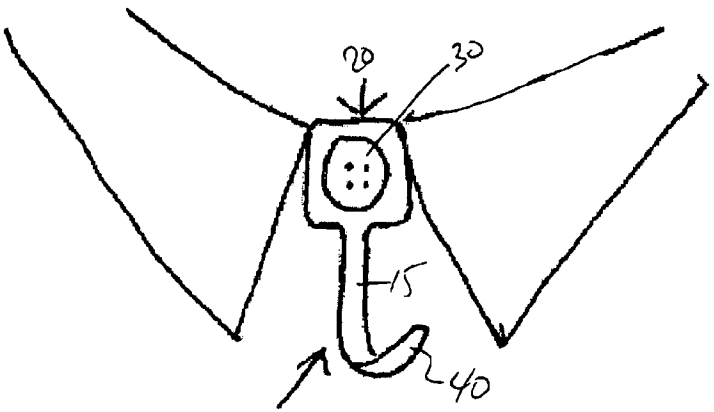
FIG. 1

PRESSURE RELIEVING TIE HOLDER

FIELD OF THE INVENTION

The invention relates generally to the field of clothing accessories and is specifically directed to a pressure relieving holder for neckties.

BACKGROUND OF THE INVENTION

Although usage of neckties has generally diminished over the past several years, they are still worn with regularity. Neckties, also referred to herein as "ties," are part of most men's wardrobes, and their use is still essentially required in many situations. Nonetheless, many men consider wearing neckties to be a nuisance, in large part because they are often not comfortable to wear. Moreover, the diminished use of neckties makes the occasional use seem even more uncomfortable, and the lack of regular use means that many men have shirts that are not well fitted for use with neckties. Often this is because men generally do not button their collars in normal business casual use, and do not use care in selecting the collar size of their shirts. Moreover, with the trend away from using ties, it is harder to purchase shirts with a specific collar size. Improper collar size can make wearing a necktie even more uncomfortable.

One approach to comfort problems associated with necktie usage is to simply leave the collar unbuttoned. However, it is also necessary to loosen the tie to relieve pressure on the neck, and the loosened tie will sag, such that the tie and shirt collar become separated creating an unkempt appearance that is generally contrary to the formality usually desired when using a necktie.

SUMMARY OF THE INVENTION

Accordingly, it is desired to provide a simple device that allows a user to relieve the pressure often associated with use of a necktie while maintaining the necktie in position to maintain a formal appearance.

It is a further object of the present invention to provide such a device that is inexpensive and easy to manufacture and use.

The present invention is directed to a pressure relieving tie holder that may be attached at one end to the collar button of a shirt and at the other end to a knot in a necktie worn by a user. The device of the present invention comprises a generally elongate body portion having first and second ends, a first engagement mechanism located at said first end, for attaching the necktie holding apparatus to the collar button of a shirt and a second engagement mechanism located at said second end, for attaching the necktie holding apparatus to a knot formed in a necktie. In one embodiment, the first engagement mechanism comprises a button hole in an enlarged area at the first end and the second engagement mechanism comprises a hook. In another embodiment, the first engagement mechanism is a first hook having a curvature generally lying in a first plane, and the second engagement mechanism is a second hook having a curvature in a second plane, wherein said first and second planes are generally orthogonal. Preferably the necktie holding device is made of plastic, and the distance between said first and second ends is between about 1.5 and 2.5 inches.

BRIEF DESCRIPTION OF THE DRAWINGS

FIG. 1 is a front view of a first embodiment of the present invention showing the inventive holder in position on a shirt collar.

FIG. 3 is a side view of what is shown in FIG. 2.

FIGS. 4A–4C depict three alternative embodiments of the present invention.

DETAILED DESCRIPTION OF THE INVENTION

Figure 2:
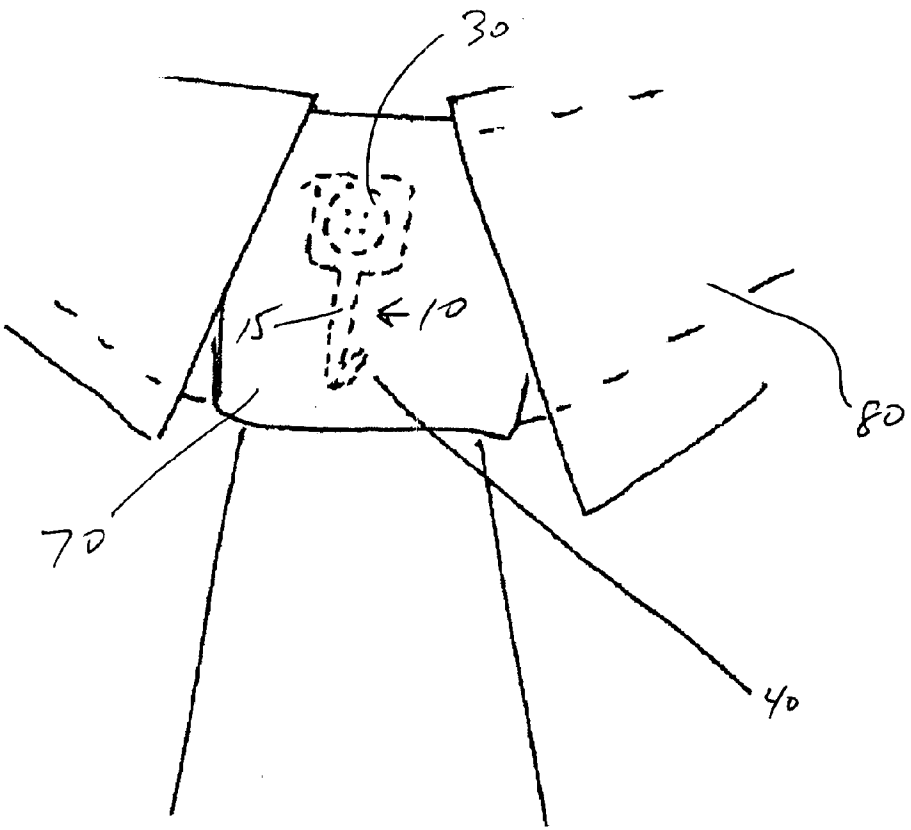
FIG. 2 is a front view, similar to FIG. 1, after a tie has been attached to the collar.

In the following description, numerous specific details are set forth to provide a more thorough description of the specific embodiments of the invention. It is apparent, however, to one skilled in the art, that the invention may be practiced without all the specific details given below. Consistent numbering is used in the Figures.

FIGS. 1–3 show an embodiment of the tie holder 10 of the present invention positioned on a shirt collar. FIG. 1 shows a front view of holder 10 of the present attached to a collar button 30 on a user's shirt prior to positioning a necktie. FIG. 2 shows the front view of FIG. 1 after the necktie has been positioned with its knot secured by the holder. FIG. 3 is a side view of what is depicted in FIG. 2.

As seen in the figures, holder 10 has a generally elongate body 15 having two ends. At the first end is an engagement mechanism for attaching holder 10 to collar button of the user's shirt. In FIGS. 1–3, the engagement mechanism comprises an enlarged end portion 20 having a buttonhole 25 formed therein. Buttonhole 25 securely attaches to the collar button 30 of the user's shirt.

The second end of elongate body 15 comprises an attachment mechanism for engaging the bottom of knot 70 in a user's necktie 80. In the preferred embodiment, this attachment mechanism is hook 40. Thus, as depicted in FIGS. 1–3, necktie 80 is securely engaged and held in position by hook 40 on holder 10. This allows a separation between the tie and the collar, while holding the tie in position while the shirt is unbuttoned. This relieves pressure in two ways: by unbuttoning the collar, and by allowing the necktie to be loosened so that the loop formed by the necktie has a slightly larger diameter than if it was fully tightened around the neck.

Preferably, holder 10 is made from plastic and is generally rigid, however, some resiliency is desirable. When formed of molded or stamped plastic, holder 10 can be manufactured and sold at a very low price, such that users will not be concerned if they are lost or broken. Preferably, the elongate body is generally flat and the holder has an overall length in the range of between about 1.5 inches to about 2.5 inches, such that the tie is held close to the top of the collar, thereby maintaining a generally formal appearance while obscuring the fact that the user's collar is unbuttoned. In an alternate embodiment, holder may be made from a formed, rigid wire having a suitable diameter. The wire may be coated with plastic, rubber or other material. Holder 10 may be offered in various colors. Although the holder is not generally visible in use, users may wish to make it even less visible by selecting a color which is similar to the user's tie. In yet another embodiment, holder 10 may be formed of precious metal, such as gold or silver.

FIGS. 4A–4C depict three exemplary alternative embodiments of holders 10 of the present invention. FIG. 4A shows an embodiment, as depicted in FIGS. 1–3, wherein the first end of the holder has a generally square enlarged portion 20. FIG. 4C is similar to FIG. 4A, but shows a generally round enlarged portion 20'. In FIG. 4B, depicts an embodiment having two hooks, one of which (hook 50) which attaches to the shirt collar button, and the other of which (hook 40) attaches to the tie. Hooks 40 and 50 are generally orthogonal to each other, i.e., hook 40 lies in one plane, such that it projects forward from the shirt collar to engage the knot on a necktie, while hook 50 lies flat against the collar, so that it lies a plane parallel to the collar button. As further depicted in FIG. 4B, the body of the holder may be generally round in cross section, rather than flat.

According to a method of practicing the present invention, a user secures one end of holder 10 to the collar button 30 of a shirt using an attachment mechanism on a first end of said necktie holder, such as enlarged buttonhole portion 20. The user then ties necktie 80, in a traditional manner, around his or her neck, securing the other end of necktie holder 10 to knot 70 of the necktie using a second attachment mechanism, such as hook 40, at the distal end of holder 10. The tie is then tightened to so that it rests snuggly on hook 40 with no slack.

The present invention thus provides a device and method for holding a necktie in position while permitting the user's collar to remain unbuttoned. The embodiments described above are illustrative of the present invention and are not intended to limit the scope of the invention to the particular embodiments described. Accordingly, while one or more embodiments of the invention have been illustrated and described, it will be appreciated that various changes can be made therein without departing from the spirit or essential characteristics thereof. Accordingly, the disclosures and descriptions herein are intended to be illustrative, but not limiting, of the scope of the invention, which is set forth in the following claims.

What is claimed is:

1. A necktie holding apparatus, comprising:

a generally elongate body portion having first and second ends, a first engagement mechanism located at said first end, for attaching the necktie holding apparatus to the collar button of a shirt, said collar button generally defining a first plane;

a second engagement mechanism located at said second end, for attaching the necktie holding apparatus to a knot formed in a necktie, wherein said second engagement mechanism is a hook having a curvature that is generally orthogonal to said first plane.

2. The necktie holding apparatus of claim 1 wherein said first engagement mechanism comprises a button hole in an enlarged area at the first end.

3. The necktie holding apparatus of claim 1 wherein said apparatus is made of plastic.

4. The necktie holding apparatus of claim 1 wherein the distance between said first and second ends is between about 1.5 and 2.5 inches.

5. The necktie holding apparatus of claim 1 wherein said elongate body is generally flat.

6. The necktie holder of claim 1 wherein said apparatus is made of metal.

7. The necktie holder of claim 6 wherein said metal necktie holder is formed from a metal wire.

8. The necktie holder of claim 6 wherein said metal is a precious metal.

9. A necktie holding apparatus, comprising:

a generally elongate body portion having first and second ends, a first engagement mechanism located at said first end, for attaching the necktie holding apparatus to the collar button of a shirt;

a second engagement mechanism located at said second end, for attaching the necktie holding apparatus to a knot formed in a necktie, wherein said first engagement mechanism is a first hook having a curvature generally lying in a first plane, and said second engagement mechanism is a second hook having a curvature in a second plane, wherein said first and second planes are generally orthogonal.

10. A necktie holding apparatus, comprising:

a plastic, generally flat elongate body having an attachment structure at a first end thereof for securing the necktie holding apparatus to the collar button of a user's shirt;

a hook at the second end of said elongate body for engaging a knot in a user's necktie, said hook having a curvature which is lies in a plane which intersects the plane defined by said generally flat elongate body;

wherein the distance between said first and second ends is between 1.5 and 2.5 inches.

11. The necktie holder of claim 10, wherein said attachment structure comprises a buttonhole for receiving said collar button.

12. A method of holding a necktie in position on a shirt having an unbuttoned collar button, comprising:

securing one end of an elongate necktie holder to the collar button of the shirt using a first attachment mechanism on a first end of said necktie holder, securing the other end of said necktie holder to the knot of a necktie using a second attachment mechanism at the second end of said necktie holder.

13. The method of claim 12, wherein said second attachment mechanism comprises a hook.

* * * * *